US006355286B2

(12) United States Patent
Deering et al.

(10) Patent No.: US 6,355,286 B2
(45) **Date of Patent: *Mar. 12, 2002**

(54) PERFORATED AIR-TIGHT SEAL MEMBRANE FOR A CANISTER CONTAINING A PARTICULATE-TYPE PRODUCT

(75) Inventors: Curtis J. Deering; Patrick J. Sumpmann, both of Maple Grove; Sarah J. Moberg, Minneapolis, all of MN (US)

(73) Assignee: General Mills, Inc., Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/346,443

(22) Filed: Jul. 1, 1999

(51) Int. Cl.[7] ..... B65D 51/22; B65D 85/00

(52) U.S. Cl. ..... 426/115; 426/122; 220/258; 220/266; 229/123.2; 229/125.05

(58) Field of Search ..... 426/106, 115, 426/122, 124, 127; 220/258, 266, 268, 359.3; 229/123.1–123.3, 125.05, 125.35, 207

(56) References Cited

U.S. PATENT DOCUMENTS

| | | | | |
|---|---|---|---|---|
| 2,719,663 A | * | 10/1955 | Meyer-Jagenberg | 229/123.3 |
| 2,971,686 A | | 2/1961 | Mühlhoff | 229/102 |
| 3,110,121 A | * | 11/1963 | Corrinett | 40/312 |
| 3,768,719 A | | 10/1973 | Johnson | 229/14 R |

(List continued on next page.)

FOREIGN PATENT DOCUMENTS

| | | |
|---|---|---|
| DE | 2641796 | 3/1977 |
| FR | 2126143 | 10/1972 |
| FR | 2243889 | 9/1974 |
| WO | 98/03403 | 1/1998 |
| WO | 99 30974 | 6/1999 |

OTHER PUBLICATIONS

A copy of PCT International Search Report mailed on Oct. 24, 2000 (8 pages).

Three–Dimensional Pioneer® Baking Mix packaging as shown in five photographs depicting different views, Copyright 1996 Pioneer Flour Mills.

*Primary Examiner*—Milton I. Cano
*Assistant Examiner*—Sherry Dauerman
(74) *Attorney, Agent, or Firm*—John A. O'Toole; Douglas J. Taylor; Thomas A. Rendos

(57) ABSTRACT

A canister for storing a particulate-type product. The canister comprises opposing face panels, opposing side panels, a bottom closure, a top closure and a seal membrane. The opposing side panels together with the opposing face panels define an upper opening and a lower opening. The bottom closure is connected to the opposing face panels so as to encompass the lower opening. The opposing face panels, the opposing side panels and the bottom closure combine to define an internal storage region. The top closure is connected to the opposing face panels so as to encompass the upper opening. The top closure is configured to provide selective access to the internal storage region. Finally, the seal membrane is connected to the inner surfaces of the opposing face and side panels adjacent to and extending beneath the top closure. The seal membrane forms a substantially air-tight seal at the upper opening to maintain integrity of particulate-type product disposed within the internal storage region. In addition, the seal membrane is configured to provide selective access to the internal storage region and thereby the particulate-type product. In one preferred embodiment, the canister is configured to store a food product, for example a ready-to-eat cereal.

57 Claims, 9 Drawing Sheets

U.S. PATENT DOCUMENTS 3,887,125 A * 6/1975 Trentesaux ..... 229/7 R
3,893,566 A * 7/1975 Ross ..... 206/498
3,944,127 A * 3/1976 Bruke et al. ..... 229/14 R
3,973,719 A * 8/1976 Johnson et al. ..... 229/5.6
4,015,771 A * 4/1977 Sengewald ..... 229/62
4,109,822 A * 8/1978 Egli ..... 220/404
4,207,725 A * 6/1980 Smith ..... 53/471
4,346,833 A * 8/1982 Bernhardt ..... 229/43
4,583,679 A * 4/1986 Johnson ..... 229/43
4,673,126 A 6/1987 Hambleton ..... 229/43
4,930,682 A * 6/1990 Gordon et al. ..... 229/123.3
4,981,229 A * 1/1991 Lanham ..... 215/232
5,566,529 A 10/1996 Sireix ..... 53/412
5,582,884 A * 12/1996 Ball et al. ..... 428/34.1
5,727,819 A 3/1998 Grosskopf et al. ..... 283/81
5,778,639 A 7/1998 Sireix ..... 53/432

* cited by examiner

PERFORATED AIR-TIGHT SEAL MEMBRANE FOR A CANISTER CONTAINING A PARTICULATE-TYPE PRODUCT

CROSS REFERENCE TO RELATED APPLICATIONS

This patent application is related to U.S. patent application Ser. No. 09/328,917 entitled "Canister For A Particulate-Type Product" filed on Jun. 9, 1999, now abandoned, assigned to the same assignee and incorporated herein by reference thereto. In addition, this patent application is related to U.S. patent application Ser. No. 09/346,189, entitled "Double Cut Seal Membrane For A Canister Containing A Particulate-Type Product"; to U.S. patent application Ser. No. 09/346,441, entitled "Canister With Adhered Paper Layers For A Particulate-Type Product"; and to U.S. patent application Ser. No. 09/346,440, now U.S. Pat. No. 6,261,615, entitled "Canister With Venting Holes For Containing A Particulate-Type Product", all filed on even date herewith, assigned to the same assignee, and incorporated herein by reference thereto.

FIELD OF THE INVENTION

The present invention relates to canisters for containing particulate-type products. In particular, the present invention is an air-tight membrane that seals an opening within the canister to ensure freshness of a particulate-type product, such as ready to eat cereal, contained within the canister. The air tight seal membrane includes perforations that allow a consumer to easily open the membrane to gain access to the particulate-type product.

BACKGROUND OF THE INVENTION

An extremely popular form of packaging for dry, particulate-type products sold to consumers is a paper carton. A wide variety of different products are packaged in this form, ranging from consumable items such as cereals and baking goods to nonconsumable items such as laundry detergents and de-icing salt pellets. Paper cartons present a number of advantages for manufacturers, retailers and ultimate consumers. For example, paper cartons are relatively inexpensive to manufacture and provide a number of flat surfaces onto which product or promotional information can be displayed. Further, paper cartons normally assume a rectangular, parallel-piped shape and are therefore readily stackable. Thus, a retailer can maximize shelf space while fully displaying the product. Obviously, consumers likewise find the stackability characteristic desirable for home storage. Finally, paper cartons are typically sized in accordance with consumer preferences such that a desired amount or volume of product is provided with each individual carton.

Certain types of products are amenable to storage within a paper carton alone. Generally speaking, however, a paper carton connot, in and of itself, prevent degradation of the contained product to adequately maintain product integrity. For example, a paper carton likely will not prevent aroma, flavor, moisture, grease, oil, contaminants, small insects, etc. from passing through to the contained product. Thus, packaging for virtually all particulate-type products requires an additional container or liner disposed within the paper carton. This is especially true for consumable/food products. A widely accepted technique for maintaining product integrity is to place the product into an inner container or bag, that in turn is stored in the carton (commonly referred to as a "bag in a box"). The bag is typically made of a plastic or glassine material and is sealed about the product. In this sealed form, the bag maintains product freshness and protection against insect infestation, whereas the outer paper carton provides packaging strength and display. Alternatively, a double packaging machine (DPM) technique may be employed to form a plastic or glassine liner within a paper carton. Regardless of the exact manufacturing process, the resulting packaging configuration includes a box with an inner liner that serves as a barrier material. One readily available example of this packaging approach is a ready-to-eat cereal, although it should be understood that a wide variety of other products are similarly packaged.

The box with an inner liner packaging approach is universally employed. In fact, from a manufacturer's standpoint, box with an inner liner packaging satisfies a number of important criteria including low cost, stackability, and large, flat surfaces for displaying product and promotional information. Unfortunately, however, consumers may encounter several potential drawbacks. These possible disadvantages are perhaps best illustrated by reference to a ready-to-eat cereal product.

Most ready-to-eat cereal products are sold to consumers in the box with an inner liner packaging format. Thus, to consume the cereal, the user must first open the paper carton. In this regard, a top portion of the carton typically forms at least two flaps folded on top of one another. The flaps are normally at least partially adhered to one another with an adhesive. By pulling or otherwise tearing one flap away from the other, a consumer can then access the inner bag. An all too common problem is that the selected adhesive creates too strong of a bond between the flaps, making flap separation exceedingly difficult. In fact, consumers may become frustrated with the separation process and resort to partially or completely tearing both flaps away from the carton. A related problem is found with a reclosure feature often times incorporated into the flaps. For example, one of the flaps may be provided with a tab, whereas the other flap includes a perforated slot positioned to receive the tab for reattachment of one flap to the other. Obviously, where the consumer has torn both flaps from the carton, the reclosure feature is unavailable. Additionally, the reclosure feature is sometimes difficult for a consumer to understand and properly use. For example, consumers often tear the flap in the region Of the slot such that the slot can no longer maintain the tab.

Once the carton has been opened, the consumer must then open the inner bag. Once again, this may be a cumbersome procedure. More particularly, an elongated seal is typically formed and extends along a top portion of the bag. This seal is broken (or "opened") by pulling apart opposite sides of the bag. In some instances, the so-formed seal is too rigid for simple opening. Even further, a person with reduced dexterity and strength, such as a child or elderly individual, may have difficulty in breaking an even relatively light seal. As a result, attempts at opening the inner bag or liner often result in an undesirable tear along a side of the bag, causing unacceptable product displacement from the bag, or an uneven opening. The person may resort to using a knife or scissors, possibly resulting in bodily harm to the user.

Once the carton and bag or liner have been opened, the consumer is then ready to pour the contents from the package. Due to the flexible nature of the inner bag, the actual opening through which the product flows is unpredictable. That is to say, the opening formed in the bag is not uniform or fixed. As a result, a larger than expected volume of product may unexpectedly pour from the container. Alternatively, where the inner bag has not been properly opened, product flow may be too slow. Further, although the flaps will have been folded upwardly to allow for product flow, an inherent bias or bend typically causes the flaps to extend upwardly relative to a top of the carton. Thus, the flaps will impede a user from visually confirming acceptable product volume and flow. As a result, the user may not be able to visually identify an unacceptable product flow rate until after an undesirably large volume of product has been distributed from the package. Additionally, the inner bag typically is not secured to the carton. During a subsequent pouring operation, then, the entire bag may undesirably be released from the carton. Finally, a potential concern arises relating to the ease with which a user can handle the carton during the pouring operation, To this end, the carton is typically configured to form an elongated rectangular cylinder having four rigid, ninety-degree corners. This rigid construction can render grasping of the package difficult, especially for a user with limited hand dexterity, such as a child or elderly individual.

A further consumer concern relating to box with an inner liner packaging stems from attempts to reclose the package for subsequent storage of remaining product. Again with reference to widely employed ready-to-eat cereal packaging, following dispensing of a portion of the cereal from the package, the user is then required to roll or fold the top portion of the bag or liner over onto itself so as to "close" the bag. It is not uncommon for a user to simply forget to perform this operation. Alternatively, even where an attempt is made, the bag cannot be resealed and thus remains at least partially open. Similarly, the bag may subsequently unroll. Individual cereal pieces may then undesirably be released from the bag and/or contaminants can enter into the bag. Regardless, the above-described reclosure feature associated with the carton normally does not provide an effective barrier to unexpected product displacement and/or contamination due to removal, poor design, misuse, lack of use, etc. These concerns are exacerbated when attempting to store a previously-opened package on its side or when the package is accidentally dropped. In either case, because neither the carton nor the bag provides a complete closure, unanticipated release of cereal from the container may occur.

Viewed as a whole, concerns relating to standard box with an inner liner packaging present numerous opportunities for consumer dissatisfaction. Essentially, consumer preferences for improvements to particulate-type product packaging can be separated into four categories. Consumers prefer that the package be easy to open, easily and satisfactorily reclosed, facilitate consistent and easy pouring and is acceptable for "clean" use by a child or others with limited dexterity. Obviously, consumers further prefer that product costs be as low as possible, and that certain other beneficial attributes associated with the existing box with inner liner packaging continue to be implemented. These existing properties include package strength, product damage protection, use of high volume commercially available materials, visual display of product and promotional material, recycleability, stackability, and moisture, aroma, contaminant and insect protection.

Certain packaging schemes are available that address, at least in part, several of the above-listed consumer preferences. Unfortunately, however, these packaging techniques entail other drawbacks, thereby limiting their usefulness. For example, rigid plastic containers having removable, sealable lids are available. The greatly increased costs associated with this packaging configuration prohibit its implementation on a mass production basis. Similarly, it may be possible to provide the inner bag with a "zip-lock" sealing feature. While this technique may alleviate several of the reclosure issues previously described, the zip-lock design is expensive and often times does not provide a complete seal.

Consumers continue to express a high demand for particulate-type products sold in a paper cartons. However, various problems associated with use of standard packaging, and in particular box with an inner liner packages, may diminish purchasing enthusiasm. In fact, any efforts to satisfy consumer preferences on a cost effective basis while maintaining the beneficial properties of current packaging, will likely result in heightened sales. Therefore, a need exists for a particulate-type product canister configured to address consumer use preferences. In particular, there is a need for an inner liner that maintains the freshness and the integrity of the particulate-type product, by preventing such things as contaminants, flavor aroma, moisture, oil, grease, small insects, etc. from passing through to the contained product, while being relatively easy to open, especially for a consumer with limited hand dexterity, such as a child or elderly individual.

SUMMARY OF THE INVENTION

One aspect of the present invention provides a canister for storing a particulate-type product. The canister includes a main body portion, a bottom closure, a top closure and a seal membrane. The main body portion has an inner surface and an outer surface. The main body portion defines an upper opening and a lower opening. The bottom closure is connected to the main body portion so as to encompass the lower opening. The main body portion and the bottom closure combine to define an internal storage region. The top closure is connected to the main body portion so as to encompass the upper opening. With this in mind, the top closure is configured to provide selective access to the internal storage region. Finally, the seal membrane is connected to the inner surface of the main body portion adjacent to and extending beneath the top closure. The seal membrane forms a substantially air-tight seal at the upper opening to maintain integrity of particulate-type product disposed within the internal storage region. In addition, the seal membrane is configured to provide selective access to the internal storage region and thereby particulate-type product. In one preferred embodiment, the canister is configured to maintain a food product such as ready-to-eat cereal.

Another aspect of the present invention relates to a packaged good article comprising a canister and a particulate-type product. The canister includes a main body portion, a bottom closure, a top panel and a seal membrane. The main body portion has an inner surface and an outer surface. The main body portion defines an upper opening and a lower opening. The bottom closure is connected to the main body portion so as to encompass the lower opening. The main body portion and the bottom closure combine to define an internal storage region. The top closure is connected to the main body portion so as to encompass the upper opening. As such, the top closure is configured to provide selective access to the internal storage region. The particulate-type product is disposed and contained within the internal storage region. The seal membrane is connected to the inner surface of the main body portion adjacent to and extending beneath the top closure. With the above combination in mind, the seal membrane forms a substantially air-tight seal at the upper opening to maintain integrity of the particulate-type product disposed within the internal storage region. In addition, the seal membrane is configured to provide selective access to the internal storage region and thereby the particulate-type product. In one preferred embodiment, the particulate-type product is a dry, ready-to-eat cereal.

During use, a user opens the canister by opening the top closure and the seal membrane. With the top closure and the seal membrane opened, the particulate-type product is distributed from the canister. Following distribution of a desired quantity of product, the top closure is returned to a closed position, effectively resealing the canister. The seal membrane prior to opening maintains the freshness and the integrity of the particulate-type product by preventing such things as contaminants, flavor, aroma, moisture, grease, oil, small insects, etc. from passing through to the particulate-type product contained within the canister. The seal membrane is designed to be relatively easy to open, especially for individuals with limited hand dexterity.

DETAILED DESCRIPTION OF THE PREFERRED EMBODIMENTS

Figure 1:
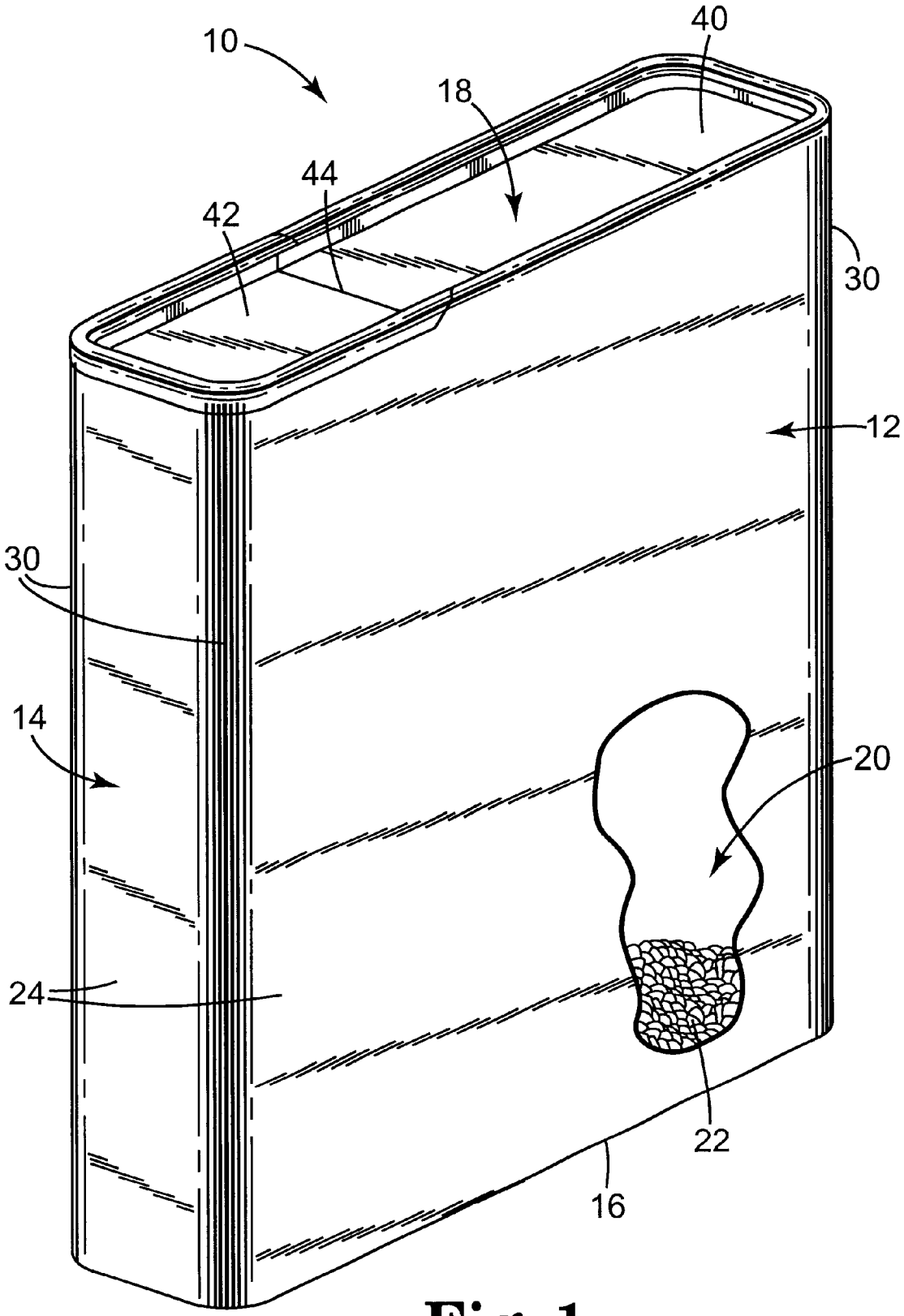
FIG. 1 is a perspective view of a canister in accordance with the present invention with a portion cut away.

A canister 10 in accordance with the present invention is shown generally in FIGS. 1–4. The canister 10 includes opposing face panels 12 (one of which is shown in FIG. 1), opposing side panels 14 (one of which is shown in FIG. 1), a bottom closure, such as bottom panel 16 (shown partially in FIG. 1) and a top closure, such as top panel 18. The opposing face and side panels 12, 14 define a main body portion of the canister 10. As seen best in FIG. 4, each of the opposing face panels 12 and each of the opposing side panels 14 includes an inner surface 23 and an outer surface 24. As described in greater detail below, the opposing face panels 12 and the opposing side panels 14 are preferably integrally formed. In this regard, the combination of the opposing face panels 12 and the opposing side panels 14 defines an upper opening 60 (shown partially in FIG. 10) and a lower opening 62 (shown partially in FIG. 10). The bottom panel 16 is connected to the opposing face panels 12 and the opposing side panels 14 at a lower portion thereof. Similarly, the top panel 18 is connected to the opposing face panels 12 and the opposing side panels 14 at an upper portion thereof. This configuration provides for an internal storage region 20 (shown partially in FIG. 1) within which a particulate-type product 22 is disposed. Notably, directional terminology such as "bottom", "top", "upper" and "lower" are used for purposes of illustration and with reference to a desired upright orientation of the canister 10 as shown in FIG. 1. However, the canister 10 can be positioned in other orientations such that the directional terminology is in no way limiting.

Each of the panels 12–18 is formed from a paper and plastic material. For example, as seen best in FIGS. 4 and 5, in one preferred embodiment, a layer of plastic 19 is adhered or laminated to a layer of paper or paperboard 21 to form each of the panels 12–18. Multiple layers of plastic and/or paper can also be employed. Alternatively, a plastic material or resin can be intertwined with the fibers of a paperboard. Regardless of exact construction, the resulting panels 12–18 are preferably formed to allow printing or similar displays on an outer surface 24 (shown generally in FIG. 1) thereof Thus, the panels 12–18 are preferably highly similar in appearance to currently available box with an inner liner cartons. Further, the combination paper and plastic material is preferably recyclable and provides a functional barrier to at least one of flavor, aroma, moisture, oil, grease, other contaminants, insects, etc. The selected plastic must be suitable for contact with the particulate-type product 22. For example, where the particulate-type product 22 is a food product, the selected plastic material must be approved for food contact, as is well known in the art. Thus, for example, the plastic material can be polyethylene (low density or high density), chlorinated plastic, ethylene vinyl acetate, polyester, nylon, polypropylene, etc. Even further, the plastic can be various co-polymers, blends or a combination of plastic materials.

By forming the panels 12–18 from a combination of paper and plastic material, the resulting canister 10 is semi-rigid (due to the paper board material), and is able to serve as a functional barrier (via the plastic material) to at least one of aroma, flavor, moisture, oil, grease, insects or other contaminants. Thus, the canister 10 can be used to maintain a wide variety of particulate-type products. For example, the particulate-type product 22 can be a food product, and in particular a dry food product. One specific category of available food products is cereal-based products (e.g., formed from wheat, oats, rice, etc). These include ready-to-eat cereals such as puffs, flakes, shreds, and combinations thereof. Further, the ready-to-eat cereal product can include other ingredients such as dried fruits, nuts, dried marshmallows, sugar coatings etc. Alternatively, other particulate-type dry food products ran be maintained by the canister 10 such as, for example, popcorn (popped or unpopped), dried pasta (e.g., spaghetti noodles), rice, beans, pretzels, potato chips, sugar, dried milk, flour, etc. Even further, other consumable items such as birdseed can be used as the particulate-type product 22. Yet even further, non-consumable particulate-type products can be stored including fertilizer pellets, dry laundry detergent, dry dishwashing detergent, plant or vegetable seeds, de-icing salt pellets, etc. Regardless of the exact product selected for the particulate-type product 22, the combination paper and plastic material comprising the panels 12–18 facilitates the canister 10 maintaining integrity of the product 22 independent of any additional liners or bags. That is to say, the panels 12–18 provide a barrier to at least one of flavor, aroma, moisture, oil, grease, insects and other contaminants, etc. thereby protecting the product 22 and maintaining freshness.

With the above-described paper and plastic composition of the panels 12–18 in mind, the opposing face panels 12 and the opposing side panels 14 are preferably integrally formed. Alternatively, the opposing face panels 12 and the opposing side panels 14 can be independently formed and subsequently secured to one another. Regardless, the opposing face panels 12 and the opposing side panels 14 are preferably sized to maintain a preferred volume of the particulate-type product 22. To this end, a resulting shape of a combination of the opposing face panels 12 and the opposing side panels 14 preferably corresponds with a shape and size of "standard" packaging normally associated with the product 22. Thus, where the product 22 is a ready-to-eat cereal, the shape and size of the opposing face panels 12 and the opposing side panels 14 is preferably highly similar to the size and shape of a carton within which the cereal is normally provided. By employing a similar package size, consumers will be familiar with and readily identify contents of the canister 10. Thus, in one preferred embodiment, the opposing face panels 12 each have a height of approximately 12 inches and width of approximately 8 inches, whereas the opposing side panels 14 each have a width of approximately 2¾ inches and a height of approximately 12 inches. Importantly, a wide variety of other sizes, either greater or smaller, and shapes are equally acceptable.

Regardless of the exact size and shape, the opposing face panels 12 and the opposing side panels 14 combine to form a plurality of longitudinally extending corners 30. In one preferred embodiment, four of the longitudinally extending corners 30 are provided (three of which are shown in FIG. 1). As illustrated in FIG. 1, each of the longitudinally extending corners 30 is preferably rounded. Each of the corner 30 is arcuate in transverse cross-section. By forming the corners 30 in this manner, the canister 10 facilitates easy handling by a user (not shown). Unlike a "standard" paper carton design in which the corners are formed as sharp, ninety-degree angles, the preferred arcuate configuration of the corners 30 comfortably fits within a user's hand. This preferred feature allows a user with limited hand dexterity (such as a child or elderly individual) to easily grasp and maneuver the canister 10. While all of the corners 30 are depicted in FIG. 1 as being rounded, as few as one of the corners 30 can be so-formed yet still provide a "easy-to-handle" characteristic. Even further, one or both of the opposing side panels 14 can be rounded or bowed to facilitate easy handling.

The bottom panel 16 is sized in accordance with a cross-sectional shape of the combination of the opposing face panels 12 and the opposing side panels 14. Thus, the bottom panel 16 is preferably curvilinear, having relatively straight sides and arcuate or curved corners.

Figure 2:
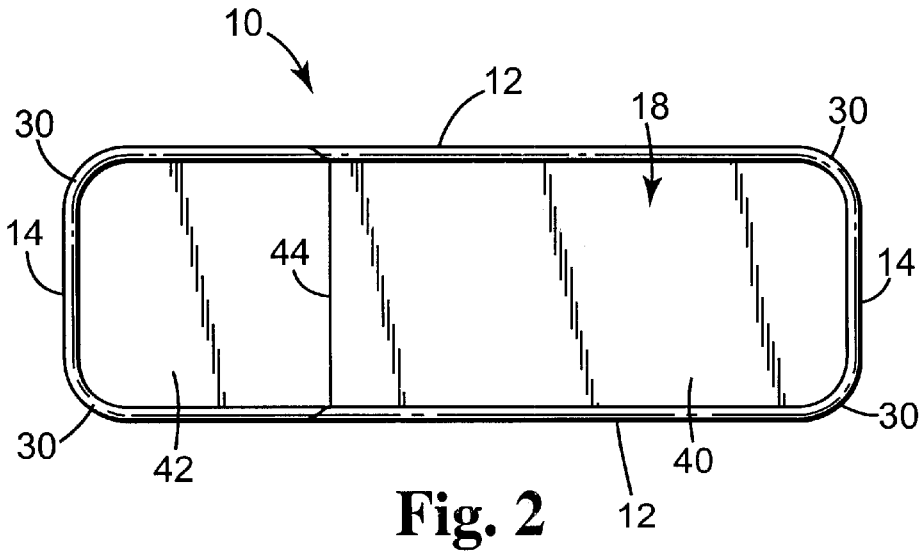
FIG. 2 is a top view of the canister of FIG. 1.

The top panel 18 is similarly sized in accordance with a cross-sectional shape of the opposing face panels 12 in combination with the opposing side panels 14. As a result, the top panel 18 preferably has relatively straight sides and arcuate or curved corners. One preferred embodiment of the top panel 18 is shown in FIG. 2. The top panel 18 is depicted as including a body portion 40 and a lid 42. As a point of reference, the lid 42 is shown in FIG. 2 in a closed position whereby the lid 42 is substantially contiguous with the body portion 40. In general terms, the lid 42 is preferably configured to be movable relative to the body portion 40. Thus, in one preferred embodiment, the lid 42 is pivotable relative to the body portion 40 along a pivot point 44. This pivoting relationship can be created by forming a bend into the top panel 18. Alternatively, an additional hinge body can be provided. Conversely, the lid 42 can be configured so as to be entirely removable from the body portion 40, such as along a perforation line. In this regard, the body portion 40 can be configured to include a ridge to which the lid 42 snap fits. Regardless of exact construction, however, the top panel 18 is preferably configured such that the lid 42 is maintained in a closed position (FIG. 2) by frictional engagement with the body portion 40.

Figure 3:
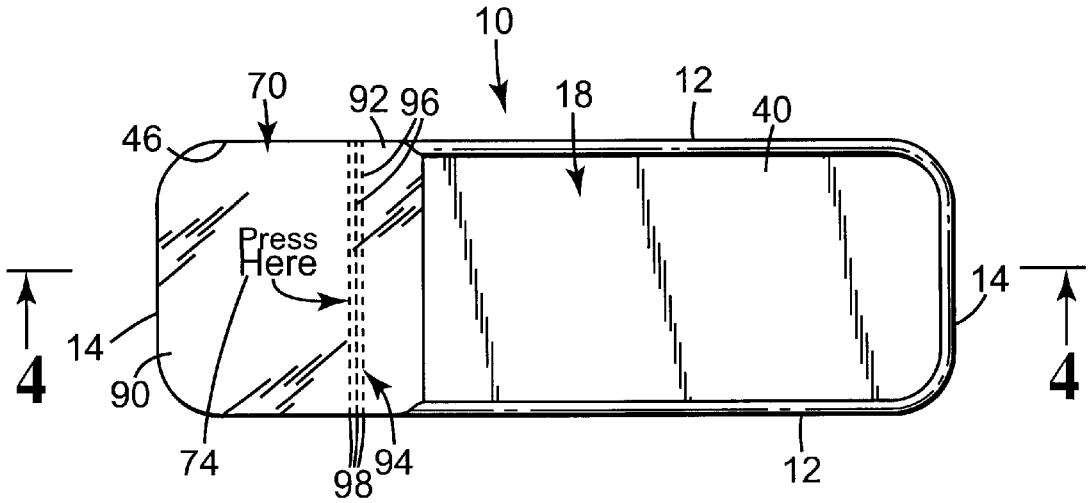
FIG. 3 is a top view of the canister of FIG. 1 with a movable lid portion removed for clarity illustrating a perforated air-tight seal membrane of the canister in accordance with the present invention.
Figure 4:
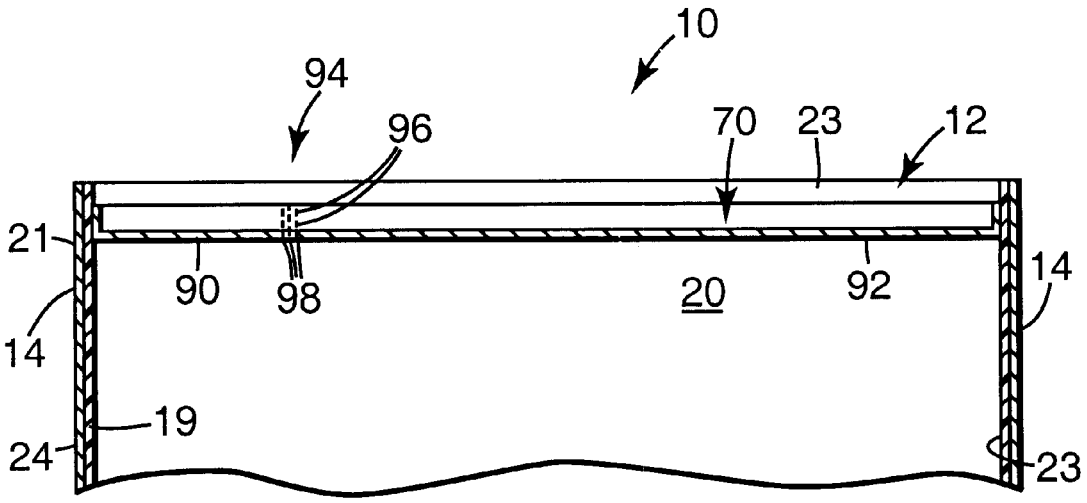
FIG. 4 is a partial sectional view taken along line 4—4 in FIG. 3 with a top panel of the canister completely removed for clarity.
Figure 5:
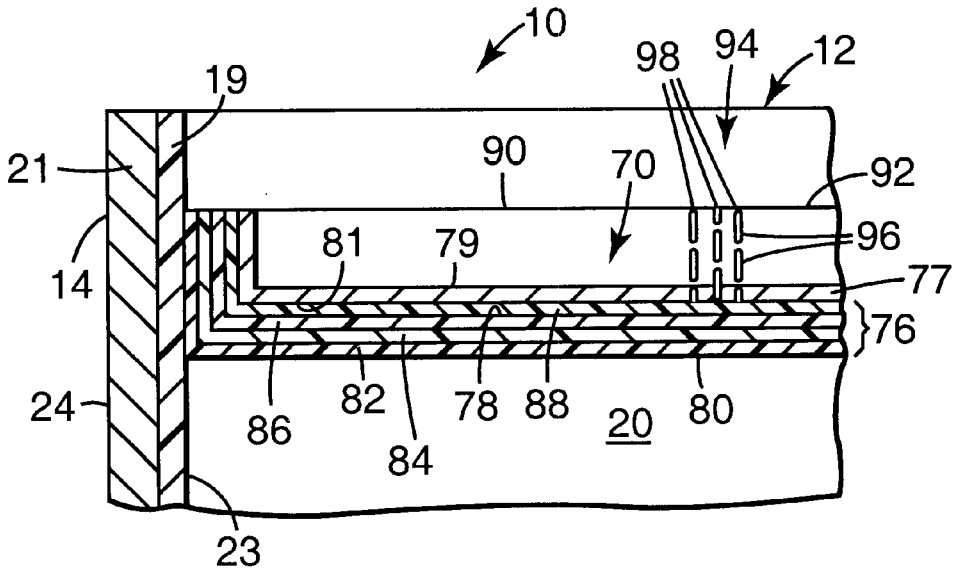
FIG. 5 is a greatly enlarged, partial sectional view similar to FIG. 4 showing details of the perforated air-tight seal membrane.

As seen best in FIGS. 3–5, in accordance with the present invention, the canister 10 further includes an airtight seal membrane 70 to enhance product freshness and to provide an indication of product tampering. For ease of illustration, the canister 10 is shown in FIG. 3 with the lid 42 (FIG. 2) removed. The seal membrane 70 is preferably positioned adjacent to and beneath the top panel 18. The seal membrane is affixed to the inner surfaces 23 of the opposing face and side panels 12 and 14 so as to extend across the entire upper opening 60 of the canister 10. The seal membrane 70 forms an air-tight seal at the upper opening 60 that acts to maintain the integrity and freshness of the particulate-type product 22 within the internal storage region 20 of the canister 10.

As seen best in FIG. 5, the seal membrane 70 preferably includes a first substrate 76 and a second substrate 77. The first substrate 76 has an upper surface 78 and a lower surface 80. The lower surface 80 of the first substrate 76 is immediately adjacent the particulate-type product 22 within the internal storage region 20. The second substrate 77 has an upper surface 79 and a lower surface 81. The upper surface 79 of the second substrate 77 is immediately adjacent the top panel 18 and constitutes an outer surface of the seal membrane 70. The first substrate 76 includes an initial residual ply 82, an intermediate delamination ply 84 and a final barrier ply 86. A lower surface of the residual ply 82 defines the lower surface 80 of the first substrate 76. An upper surface of the barrier ply 86 defines the upper surface 78 of the first substrate 76. The lower surface 81 of the second substrate 77 is affixed to the upper surface 78 of the first substrate 76 (i.e., the upper surface of the barrier ply 86) via a suitable adhesive 88. Alternatively, the second substrate 77 and the first substrate 76 can be joined by a heat lamination process, or the second substrate 77 may be extruded directly onto the first substrate 76 or vice versa.

The first substrate 76, and in particular, the barrier ply 86 of the first substrate 76, provides an air-tight, functional barrier to at least one of flavor, aroma, moisture, oil, grease, insects, other contaminants, etc. This functional barrier maintains the integrity and freshness of the particulate-type product 22 contained within the internal storage region 20 of the canister 10 by preventing the passage of these contaminants through to the product 22. The residual ply 82 serves to attach the seal membrane 70 to the inner surfaces 23 of the opposing face and side panels 12 and 14. In one preferred embodiment, the seal membrane 70 is attached to the canister 10 via a heat lamination process that affixes the residual ply 82 to the layer of plastic 19 on the opposing face and side panels 12 and 14. Alternatively, an ultrasonic welding process can be used to affix the seal membrane 70 to the canister 10. The delamination ply 84 permits separation of the remaining portions of the seal membrane 70 (i.e., the second substrate 77, the adhesive 88, the barrier ply 86 and the delamination ply 84) from the residual ply 82, to facilitate selective removal of at least a portion of the seal membrane 70 from the upper opening 60 to provide selective access to the internal storage region 20 and the particulate-type product 22 contained therein. The functionality of this delamination ply 84 is explained in detail below, In one preferred embodiment, the second substrate 77 is comprised of oriented polypropylene, the barrier ply 86 is comprised of high density polyethylene, the delamination ply 84 is comprised of ethylene vinyl acetate, and the residual ply 82 is comprised of metalicine polyethylene. This form of the seal membrane 70 is available from Banner Corporation of Oshkosh, Wis.

Figure 7:
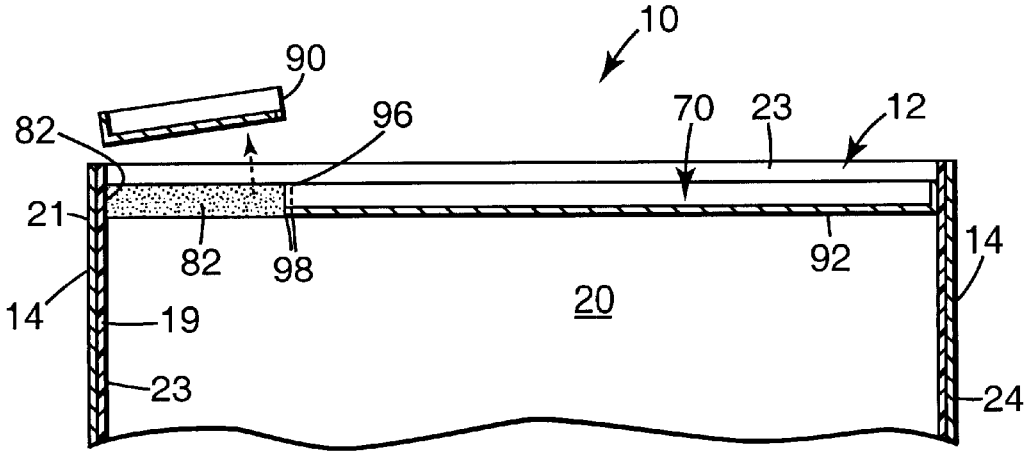
FIG. 7 is a partial sectional view taken along line 7—7 in FIG. 6 with a top panel of the canister completely removed for clarity.
Figure 8:
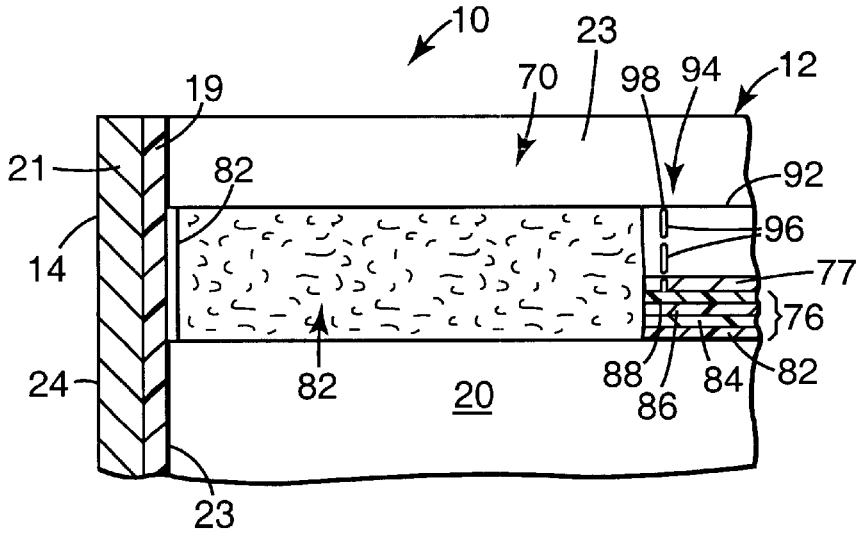
FIG. 8 is a greatly enlarged, partial sectional view similar to FIG. 7 showing details of the perforated air-tight seal membrane.

As seen in FIG. 3, the seal membrane 70 includes an internal storage region access portion 90 and a main portion 92 (i.e., remaining portion). To facilitate removal of the access portion 90 from the main portion 92 so as to provide selective access to the internal storage region 20 and the particulate-type product 22 contained therein, the seal membrane 70 is preferably formed to include a perforated region 94 defined by a plurality of perforations 96. As seen best in FIG. 5 these perforations 96 extend through the second substrate 77 from the upper surface 79 to the lower surface 81. As such, the functional barrier provided by the first substrate 76 is unaffected by the perforations 96 since the perforations 96 do not extend into or through the first substrate 76. As seen best in FIGS. 6–8, separation of the access portion 90 from the main portion 92 of the seal membrane 70 occurs at the perforated region 94 upon light finger pressure applied by a user directly to the perforated region 94. As such, removal of the access portion 90 of the seal membrane 70 is particularly amenable to individuals with limited hand dexterity, such as a child or an elderly individual. Once separation of the access portion 90 from the main portion 92 occurs, the access portion 90 can be separated from the inner surfaces 23 of the face and side panels 12 and 14. As seen in FIGS. 7 and 8, separation of the access portion 90 from the face and side panels 12 and 14 occurs at the junction of the delamination ply 84 and the residual ply 82 leaving the residual ply 82 attached to the inner surface of the panels 12, 14.

Figure 12:
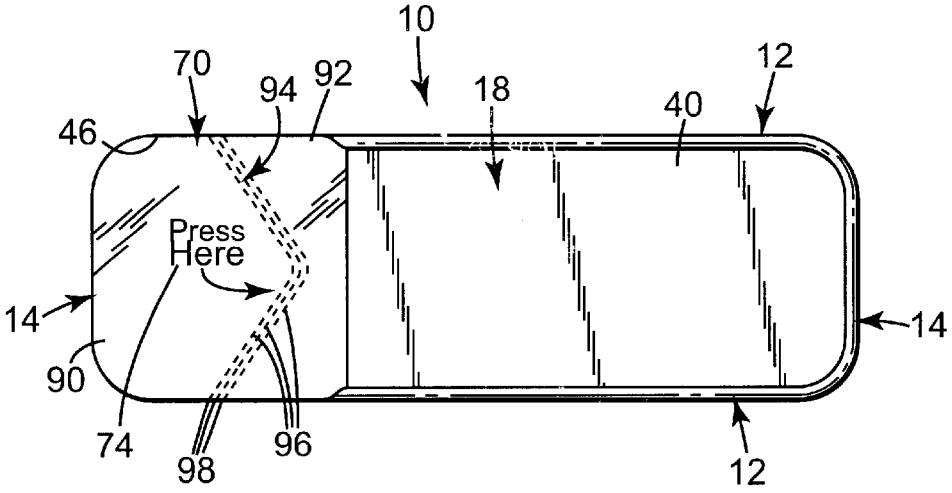
FIG. 12 is a top view of an alternative air-tight seal membrane for a canister in accordance with the present invention with a movable lid portion removed for clarity.

As seen best in FIGS. 3–5, the plurality of perforations 96 are arranged in at least one continuous, straight line 98 of perforations that extends substantially perpendicular to and between the opposing face panels 12 of the canister 10. Preferably, as illustrated best in FIG. 3, the plurality of perforations 96 are arranged in three continuous, straight lines 98 of perforations that extend substantially perpendicular to and between the opposing face panels 12 of the canister 10. These three lines 98 of perforations are closely spaced and are substantially parallel to one another. By providing three lines 98 of perforations as seen best in FIG. 8, separation of the access portion 90 from the main portion 92 of the seal membrane 70 at the perforated region 94 is ensured. Although, FIG. 8 depicts separation (i.e., fracture) of the access portion 90 from the main portion 92 at the middle line 98 of perforations, it is to be understood that separation (i.e., fracture) of the access portion 90 from the main portion 92 can occur at any one of or multiple combination of the lines 98 of perforations. The perforations 96 can be imparted to the seal membrane via any readily available manufacturing technique, such as die cutting, and can assume a wide variety of forms. In addition, the lines 98 of perforations can assume a wide variety of forms. For example, the lines 98 of perforations can assume a curved form, a single saw tooth shape (i.e., V-shaped) or a series of saw teeth appearance. The alternative embodiment single saw tooth shape or V-shape of the lines 98 of perforations is illustrated in FIG. 12. Additionally, the seal membrane 70 can include indicia 74 configured to provide visual instructions to a user for removal of the access portion 90 of the seal membrane 70. For example, the indicia 74 can include words, symbols or illustrations describing to a user the necessary steps for removal of the access portion 90 from the canister 10.

By preferably providing the movable lid 42, access to the internal storage region 20, and thus the particulate-type product 22, is easily gained once the access portion 90 of the seal membrane 70 is removed. With respect to FIG. 6, movement of the lid 42 to an open position and the removal of the access portion 90 of the seal membrane 70 generates a pour opening 46 in the top panel 18. Due to the relatively rigid nature of the top panel 18 and the main portion 92 (i.e., remaining portion) of seal membrane 70, the pour opening 46 is fixed in terms of shape and size. The pour opening 46 is preferably configured to be relatively large. For example, the pour opening 46 preferably has a width approximating a spacing between the opposing face panels 12 and length of at least one-fourth a length of the top panel 18, more preferably one-third. Alternatively, other sizes can also be useful. By providing a fixed, relatively large configuration for the pour opening 46, regulated, consistent flow of product through the pour opening 46 can be achieved as described below. In other words, the fixed pour opening 46 will not change in shape or size, unlike the standard box with an inner liner package.

Figure 6:
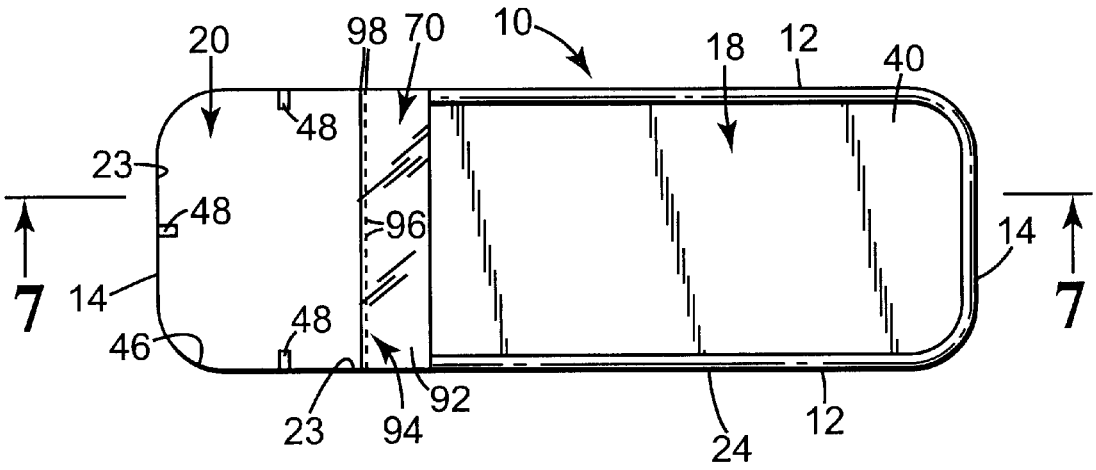
FIG. 6 is a top view similar to FIG. 3 of the canister with an internal storage region access portion of the seal membrane shown removed.

FIG. 6 further depicts one preferred approach for selectively securing the lid 42 to the body portion 40. In particular, the top panel 18 is configured to provide a plurality of tabs 48 extending from the body portion 40. The tabs 48 are sized to extend inwardly from the body portion 40, so as to engage the lid 42 (FIG. 2) in the closed position. While three of the tabs 48 are shown, any other number, either greater or lesser, can be included.

Figure 9:
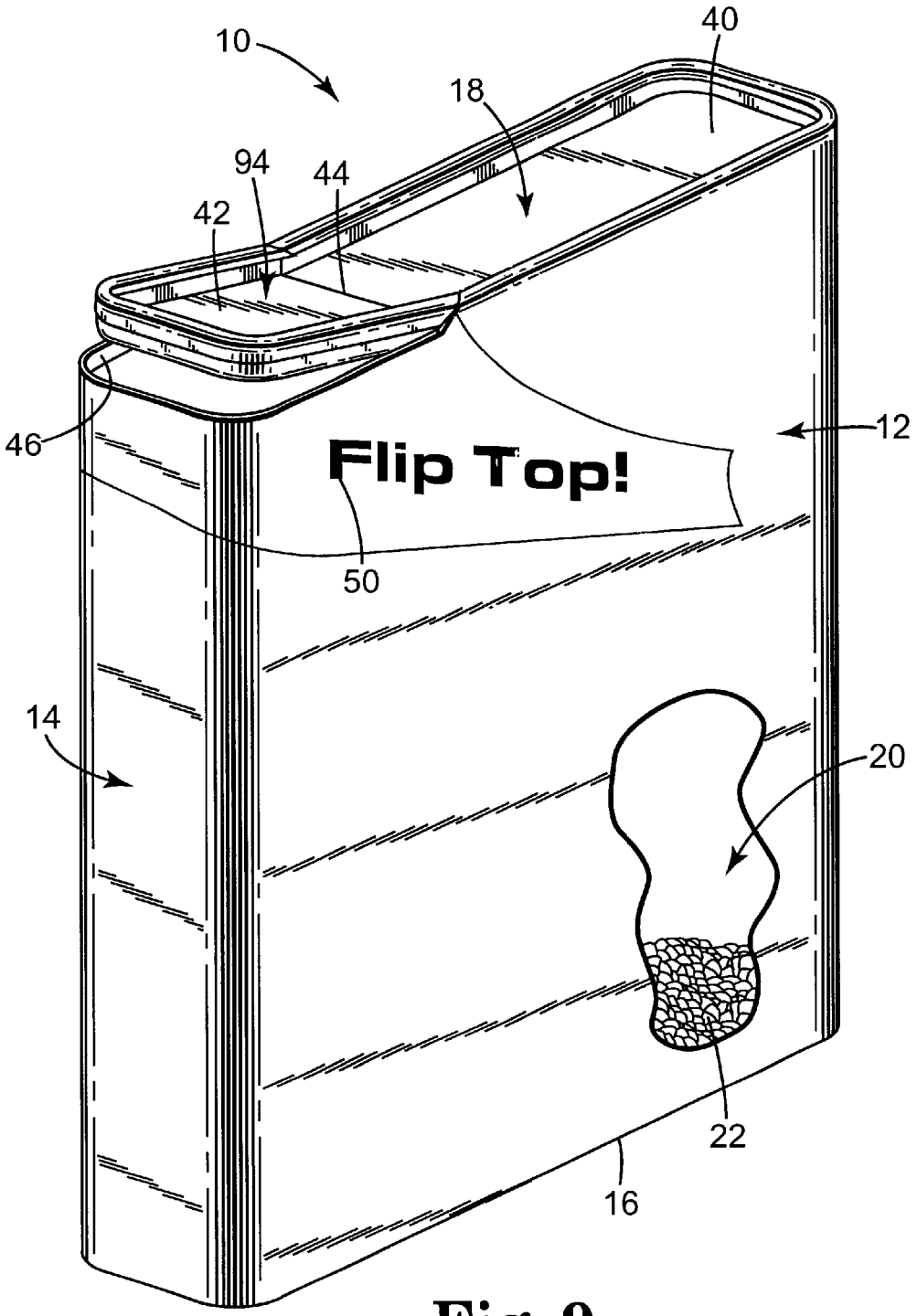
FIG. 9 is a perspective view of the canister in accordance with the present invention illustrating the movable lid portion.

Movement of the lid 42 to an open position is best shown with reference to FIG. 9. In one preferred embodiment, the top panel 18 is configured such that the lid 42 is independently maintained in the open position such as by action or other mechanical means. In other words, a user (not shown) must purposely move the lid 42 back to the closed position (FIG. 1); the lid 42 will not unexpectedly "close" on its own. As further shown in FIG. 9, the canister 10 preferably includes indicia 50 providing visual guidance and/or instructions relating to proper operation of the movable lid 42. The indicia 50 can be formed on any of the panels 12–18, and can extend or be continuous from one panel, such as one of the opposing face panels 12, to another panel, such as one of the opposing side panels 14. The indicia 50 may assume a wide variety of forms, including words, symbols, illustrations, etc. In addition to providing instructions on operation of the movable lid 42, the indicia 50 can also be configured to draw a consumer's (not shown) attention to the movable lid feature, thereby potentially enticing a consumer to purchase the canister 10 and the product 22 disposed therein.

Figure 10:
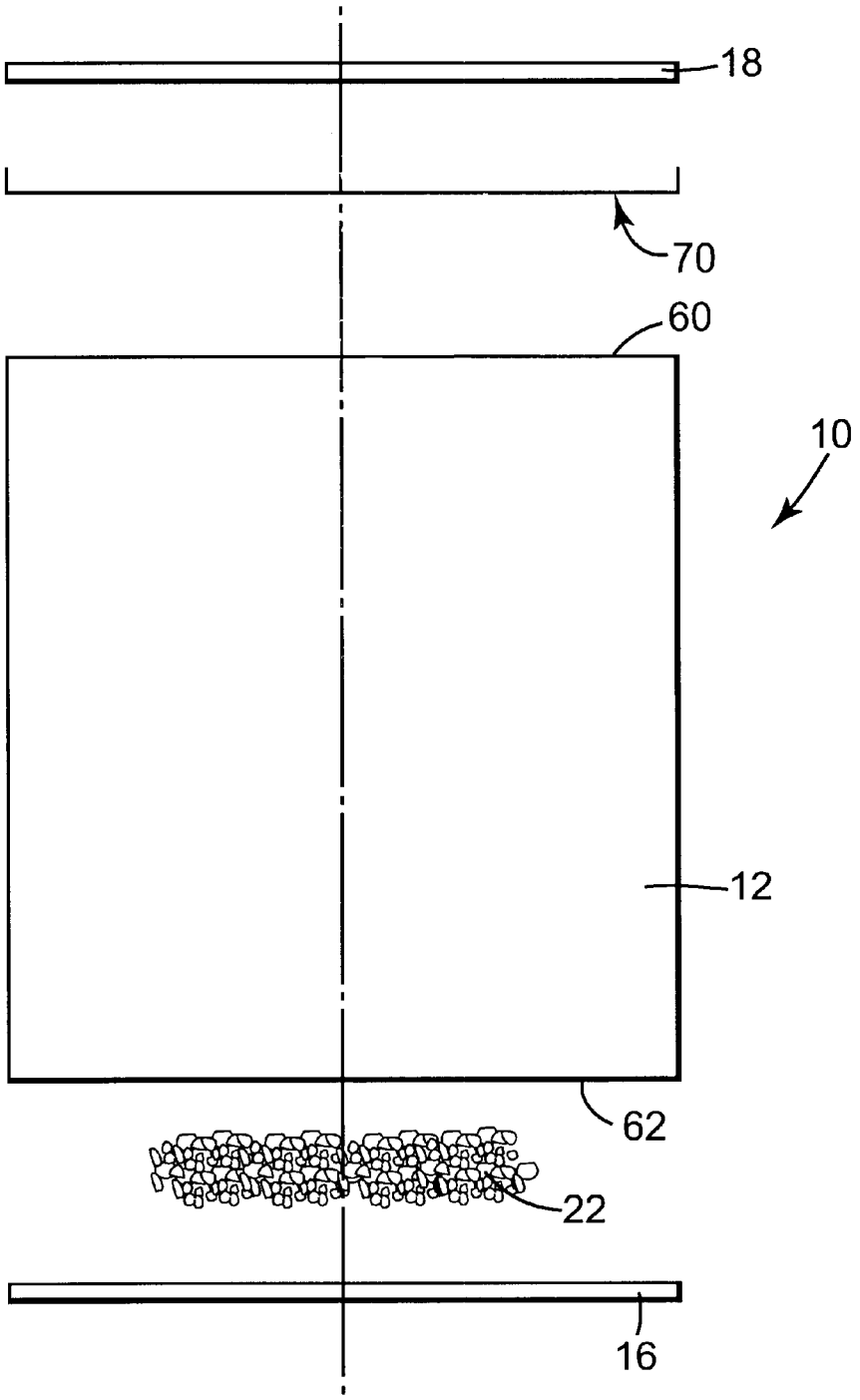
FIG. 10 is an exploded view of a canister in accordance with the present invention.

A preferable embodiment of assembly of the canister 10 is shown generally in FIG. 10. As previously described, the opposing face panels 12 and the opposing side panels 14 are preferably integrally formed. In this regard, a combination of the opposing face panels 12 and the opposing side panels 14 defines the upper opening 60 and the lower opening 62. Next, the seal membrane 70 is affixed to the inner surfaces 23 of the opposing face and side panels 12 and 14. In one preferred embodiment, the seal membrane 70 is laminated directly to the plastic layer 19 of the panels 12, 14. Alternatively, the seal membrane 70 can be sealed to the canister 10, or a separate attachment body, such as an adhesive tape, or other mechanical device, can be used to affix the seal membrane 70. Next, the top panel 18 is connected to the opposing face panels 12 and the opposing side panels 14 so as to encompass the upper opening 60. In one preferred embodiment, the top panel 18 is sealed to the opposing face panels 12 and the opposing side panels 14 at the upper opening 60. Alternatively, a separate attachment body, such as an adhesive tape or laminant, or other mechanical device, can be used to affix the top panel 18. Once assembled, the opposing face panels 12, the opposing side panels 14 and the top panel 18 combine to define the internal storage region 20 (FIG. 1). A desired volume of the particulate-type product 22 is then disposed within the internal storage region 20. Finally, the bottom panel 16 is connected to the opposing face panels 12 and the opposing side panels 14 so as to encompass the lower opening 62. In one preferred embodiment, the bottom panel 16 is directly sealed to the panels 12, 14. Alternatively, a separate attachment body, such as an adhesive tape or laminant, or other mechanical device, can be used to affix the bottom panel 16. Upon final assembly, the particulate-type product 22 is sealed within the internal storage region 20.

The canister 10 can also be assembled using an alternative method of assembly. In this alternative method of assembly, the opposing face panels 12 and the opposing side panels 14 are preferably integrally formed. As before, the combination of the opposing face panels 12 and the opposing side panels 14 defines the upper opening 60 and the lower opening 62. Next, the bottom panel 16 is connected to the opposing face panels 12 and the opposing side panels 14 go as to encompass the lower opening 62. As before, the bottom panel 16 is sealed to the opposing face panels 12 and the opposing side panels 14 at the lower opening 62. Alternatively, a separate attachment body, such as an adhesive tape or laminant, or other mechanical device, can be used to affix the bottom panel 16. Once assembled, the opposing face panels 12, the opposing side panels 14 and the bottom panel 16 combine to define the internal storage region 20 (FIG. 1). A desired volume of the particulate-type product 22 is then disposed within the internal storage region 20. Next, the seal membrane 70 is affixed to the inner surfaces 23 of the opposing face and side panels 12 and 14. As before, the seal membrane 70 is laminated directly to the plastic layer 19 of the panels 12, 14. Alternatively, the seal membrane 70 can be sealed to the canister 10, or a separate attachment body, such as an adhesive tape, or other mechanical device, can be used to affix the seal membrane 70. Finally, the top panel 18 is connected to the opposing face panels 12 and the opposing side panels 14 so as to encompass the upper opening 60. As before, the top panel 18 is directly sealed to the panels 12, 14. Alternatively, a separate attachment body, such as an adhesive tape or laminant, or other mechanical device, can be used to affix the top panel 18. Upon final assembly, the particulate-type product 22 is sealed within the internal storage region 20.

Figure 11:
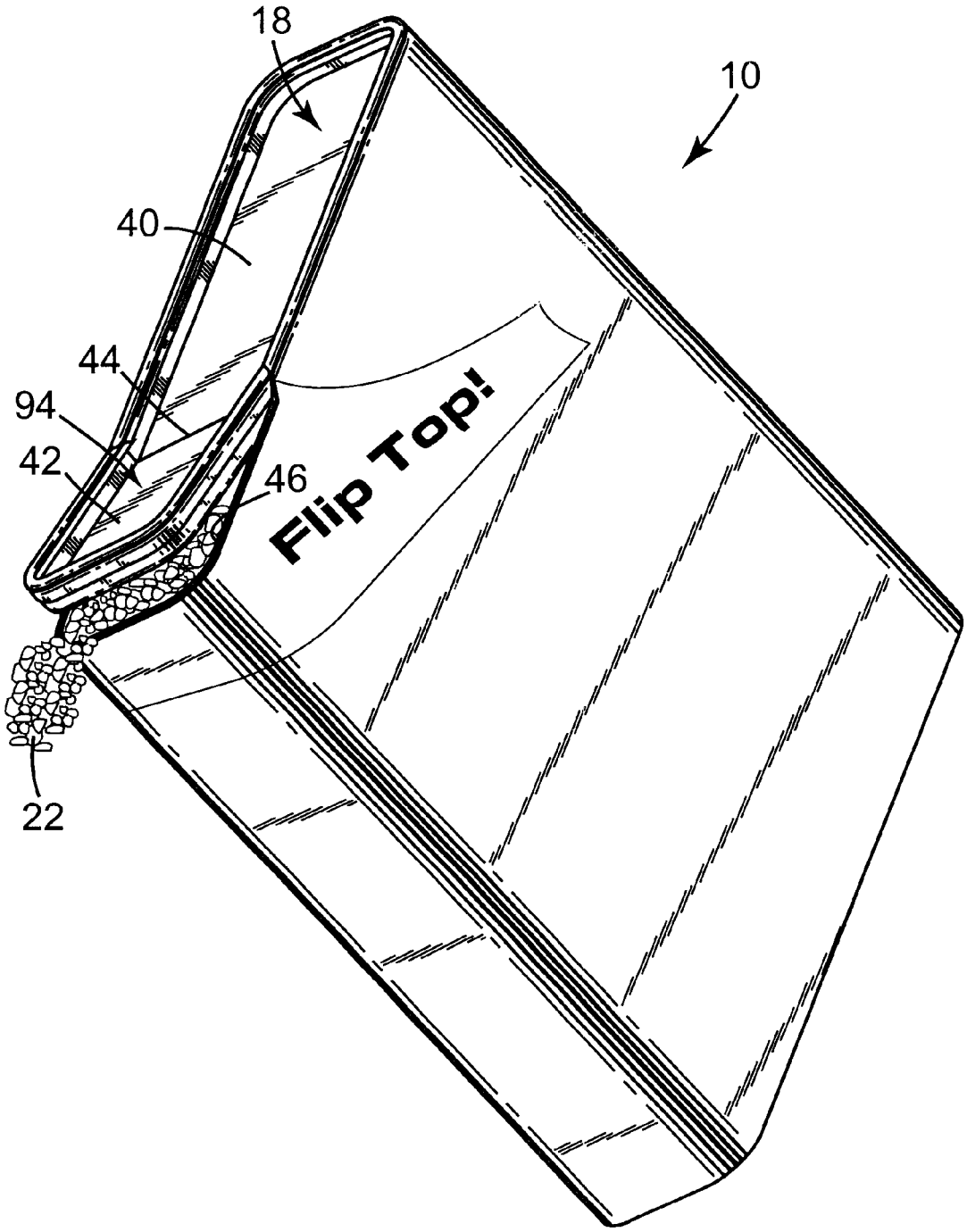
FIG. 11 illustrates a canister in accordance with the present invention in a pouring operation.

During use, the lid 42 is maneuvered from the closed position (FIG. 1) to the open position (FIG. 9). For example, the lid 42 can be pivoted relative to the body portion 40 (FIG. 2). Alternatively, the lid 42 can be entirely removed from the canister 10. Next, the access portion 90 is separated from the main portion 92 of the seal membrane 70 along the lines 98 of perforations 96 using finger pressure (FIG. 3). The access portion 90 is then grasped and separated (i.e., peeled) from the inner surfaces 23 of the face and side panels 12, 14 at the junction of the of the delamination ply 84 and the residual ply 82 leaving the residual ply 82 attached to the inner surface of the panels 12, 14 (FIG. 7). Following opening of the lid 42 and removal of the access portion 90 of the seal membrane 70, a user (not shown) is then able to pour a desired quantity of the particulate-type product 22 as shown in FIG. 11. During this pouring operation, the user is able to directly confirm product flow rate and volume. In other words, unlike a "standard" box with an inner liner design, the canister 10 of the present invention does not impede the user's view of the opening 46. In the open position, the canister 10 does not include any upwardly extending flaps or similar carton material that would otherwise obstruct viewing of the opening 46 and thus flow of the product 22 from the canister 10. Further, as previously described, the opening 46 is preferably fixed. Thus, a relatively consistent product flow and volume from the canister 10 can be achieved from use-to-use. Along these same lines, because the canister 10 does not require a separate liner or inner bag, the long standing problem of liner dislodgment during pouring will not occur. In short, the regulated product flow prevents an unexpectedly large volume of product from being distributed from the canister 10, and thereby minimizes spillage. As a point of reference with respect to FIG. 11, the lid 42 can be positioned or pivoted at a greater angle relative to the body portion 40 for pouring larger sized product particles.

Following distribution of a desired volume of the product 22 from the canister 10, the lid 42 is returned to the closed position (FIG. 1). Once again, the user is not required to fold or roll a separate inner liner or bag to effectuate closure. As previously described, the lid 42 is preferably frictionally secured in the closed position. Thus, following use and reclosure, the canister 10 provides a relatively complete functional barrier to at least one of flavor, aroma, moisture, oil, grease, contaminants, insects, etc., thereby giving a perceived increase in product freshness. Additionally, by selectively securing the lid 42 in the closed position, the canister 10 can be placed in any orientation, whether purposefully or accidentally, without undesired spillage of the product 22 from the canister 10. In other words, during normal storage, the canister 10 is typically placed upright, supported by the bottom panel 16. Alternatively, however, the canister 10 can be stored in a prone position whereby the canister is supported at one of the face panels 12, the opposing side panels 14 or the top panel 18. With any of these orientations, the lid 42 remains in the closed position, thereby preventing accidental release of the product 22. Similarly, in the event the canister 10 is inadvertently tipped from the upright position, the lid 42 will remain in the closed position, again preventing accidental product spillage.

The canister of the present invention provides a marked improvement over previous designs. Pointedly, the canister eliminates the need for, and associated problems found with, a separate plastic liner or bag required by currently used box with an inner liner packaging. Persons with limited hand dexterity are no longer required to use a hand tool, such as a knife or scissors, to open the packaging. At the same time, by utilizing the air-tight seal membrane and a combination paper and plastic material for the various panels comprising the canister, product integrity is maintained. Further, preferred features of the canister directly address consumer preferences. For example, incorporating a movable lid and easily removable sealing membrane access portion, the canister easy to open and reclose. Similarly, the movable lid and the remaining portion of the seal membrane preferably generates a fixed opening, thereby providing for consistent, regulated product flow. Additionally, the seal membrane, lid and canister of the present invention can conveniently be handled by individuals with limited hand dexterity.

Although the present invention has been described with reference to preferred embodiments, workers skilled in the art will recognize that changes may be made in form and detail without departing from the spirit and scope of the present invention. For example, the canister has been depicted as being generally rectangular in shape. Alternatively, other shapes are equally acceptable. Also, the canister can contain items in addition to the particulate-type product. For example, a coupon or premium can be placed within the canister along with the particulate-type product.

What is claimed is:

1. A canister for storing a particulate product, the canister comprising:

a main body portion having an inner surface and an outer surface, the main body portion defining an upper opening and a lower opening;

a bottom closure connected to the main body portion so as to encompass the lower opening, wherein the main body portion and the bottom closure combine to define an internal storage region for particulate product;

a top closure connected to the main body portion so as to encompass the upper opening, the top closure including:

a body portion; and a lid movably secured to the body portion, the lid member being movable from a closed position preventing access to the internal storage region and an open position providing access to the internal storage region, the lid having an upper outer surface and a lower inner surface; and a seal membrane connected to the inner surface of the main body portion adjacent to and extending beneath the top closure, with the seal membrane being substantially free of attachment to the lower inner surface of the lid, the seal membrane forming a substantially air-tight seal at the upper opening configured to maintain integrity of the internal storage region and thereby particulate product therein, with the seal membrane being configured to provide selective access to the internal storage region and thereby particulate product, wherein initial movement of the lid from the closed position to the open position does not affect the substantially air-tight seal of the seal membrane, and wherein the seal membrane defines a plurality of perforations to facilitate complete removal of only an internal storage region access portion of the seal membrane from the main body portion and the top closure to provide the selective access to the internal storage region and particulate product therein.

2. The canister of claim 1 wherein the main body portion of the canister includes:

opposing face panels, each of the opposing face panels having an inner surface and an outer surface; and opposing side panels, each of the opposing side panels having an inner surface and an outer surface, wherein the opposing face and side panels define the upper and lower openings, wherein the opposing face and side panels and the bottom closure combine to define the internal storage region, wherein the top and bottom closures are connected to the opposing face panels, and wherein the seal membrane is connected to the inner surfaces of the opposing face and side panels adjacent to and extending beneath the top closure.

3. The canister of claim 1 wherein the plurality of perforations are arranged in a continuous line of perforations.

4. The canister of claim 3 wherein the line of perforations is straight.

5. The canister of claim 4 wherein the line of perforations extends substantially perpendicular to and between the opposing face panels.

6. The canister of claim 1 wherein the plurality of perforations are arranged in at least two continuous lines of perforations.

7. The canister of claim 6 wherein there are three continuous lines of perforations.

8. The canister of claim 6 wherein each line of perforations of the at least two lines of perforations is straight.

9. The canister of claim 8 wherein the at least two lines of perforations are parallel.

10. The canister of claim 9 wherein the at least two lines of perforations are closely spaced.

11. The canister of claim 10 wherein the at least two lines of perforations extend substantially perpendicular to and between the opposing face panels.

12. The canister of claim 7 wherein each of the three continuous lines of perforations is V-shaped.

13. The canister of claim 1 wherein the seal membrane includes:

a first substrate having a first surface and a second surface, the second surface of the first substrate being immediately adjacent particulate product disposed within the internal storage region; and a second substrate having a first surface and a second surface, the second surface of the second substrate being affixed to the first surface of the first substrate, the second substrate defining the plurality of perforations, the plurality of perforations extending through the second substrate from the first surface of the second substrate to the second surface of the second substrate.

14. The canister of claim 13 wherein the first substrate is a barrier substrate that forms the substantially air-tight seal at the upper opening for maintaining integrity of particulate product disposed within the internal storage region.

15. The canister of claim 14 wherein the barrier substrate includes:

an initial residual ply, a lower surface of the initial residual ply defining the second surface of the first substrate immediately adjacent particulate product disposed within the internal storage region;

an intermediate delamination ply; and a final barrier ply, an upper surface of the barrier ply defining the first surface of the first substrate.

16. The canister of claim 15 wherein the second substrate is oriented polypropylene, the barrier ply is high density polyethylene, the delamination ply is ethylene vinyl acetate, and the residual ply is metalicine polyethylene.

17. The canister of claim 15 wherein the plurality of perforations facilitate removal of only the internal storage region access portion of the seal membrane, and wherein upon removal of the access portion from a remaining portion of the seal membrane, the access portion separates from the remaining portion of the seal membrane at the plurality of perforations and the access portion separates from the inner surfaces of the panels at a junction of the delamination ply and the residual ply so as to leave the residual ply attached to the inner surfaces of the panels.

18. The canister of claim 17 wherein the internal storage region access portion of the seal membrane includes indcia.

19. The canister of claim 17 wherein the plurality of perforations are arranged in at least two continuous lines of perforations to ensure separation of the access portion from the remaining portion of the seal membrane.

20. The canister of claim 19 wherein there are three continuous lines of perforations.

21. The canister of claim 20 wherein each of the three continuous lines of perforations is V-shaped.

22. The canister of claim 19 wherein each line of perforations of the at least two lines of perforations is straight.

23. The canister of claim 22 wherein the at least two lines of perforations are parallel.

24. The canister of claim 23 wherein the at least two lines of perforations are closely spaced.

25. The canister of claim 24 wherein the at least two lines of perforations extend substantially perpendicular to and between the opposing face panels.

26. The canister of claim 1 wherein the canister is configured to store a dry particulate product.

27. The canister of claim 1 wherein the canister is configured to store a particulate food product.

28. The canister of claim 1 wherein the canister is configured to store a particulate cereal food product.

29. The canister of claim 1 wherein the canister is configured to store a particulate ready-to-eat cereal food product.

30. The canister of claim 1 wherein the internal storage region access portion of the seal membrane includes indicia.

31. A packaged good article comprising:

a canister including:

a main body portion having an inner surface and an outer surface, the main body portion defining an upper opening and a lower opening;

a bottom closure connected to the main body portion so as to encompass the lower opening, wherein the main body portion and the bottom panel combine to define an internal storage region;

a top closure connected to the main body portion so as to encompass the upper opening, the top closure including:

a body portion; and a lid movably secured to the body portion, the lid member being movable from a closed position preventing access to the internal storage region and an open position providing access to the internal storage region, the lid having an upper outer surface and a lower inner surface; and a seal membrane connected to the inner surface of the main body portion adjacent to and extending beneath the top closure, with the seal membrane being substantially free of attachment to the lower inner surface of the lid, the seal membrane forming a substantially air-tight seal at the upper opening with the seal membrane being configured to provide selective access to the internal storage region, wherein initial movement of the lid from the closed position to the open position does not affect the substantially air-tight seal of the seal membrane, and wherein the seal membrane defines a plurality of perforations to facilitate complete removal of only an internal storage region access portion of the seal membrane from the main body portion and the top closure to provide the selective access to the internal storage region and particulate product therein; and a particulate product disposed within the internal storage region, the seal membrane being configured to maintain integrity of the particulate product disposed within the internal storage region.

32. The packaged good article of claim 31 wherein the main body portion of the canister includes:

opposing face panels, each of the opposing face panels having an inner surface and an outer surface; and opposing side panels, each of the opposing side panels having an inner surface and an outer surface, wherein the opposing face and side panels define the upper and lower openings, wherein the opposing face and side panels and the bottom closure combine to define the internal storage region, wherein the top and bottom closures are connected to the opposing face panels, and wherein the seal membrane is connected to the inner surfaces of the opposing face and side panels adjacent to and extending beneath the top closure.

33. The packaged good article of claim 31 wherein the plurality of perforations are arranged in a continuous line of perforations.

34. The packaged good article of claim 31 wherein the plurality of perforations are arranged in at least two continuous lines of perforations.

35. The packaged good article of claim 34 wherein there are three continuous lines of perforations.

36. The packaged good article of claim 35 wherein each of the three continuous lines of perforations is V-shaped.

37. The packaged good article of claim 34 wherein each line of perforations of the at least two lines of perforations is straight.

38. The packaged good article of claim 37 wherein the at least two lines of perforations are parallel.

39. The packaged good article of claim 38 wherein the at least two lines of perforations are closely spaced.

40. The packaged good article of claim 39 wherein the at least two lines of perforations extend substantially perpendicular to and between the opposing face panels.

41. The packaged good article of claim 31 wherein the seal membrane includes:

a first substrate having a first surface and a second surface, the second surface of the first substrate being immediately adjacent particulate product disposed within the internal storage region; and a second substrate having a first surface and a second surface, the second surface of the second substrate being affixed to the first surface of the first substrate, the second substrate defining the plurality of perforations, the plurality of perforations extending through the second substrate from the first surface of the second substrate to the second surface of the second substrate.

42. The packaged good article of claim 41 wherein the first substrate is a barrier substrate that forms the air-tight seal at the upper opening for maintaining integrity of particulate product disposed within the internal storage region.

43. The packaged good article of claim 42 wherein the barrier substrate includes:

an initial residual ply, a lower surface of the first residual ply defining the second surface of the first substrate immediately adjacent particulate product disposed within the internal storage region;

an intermediate delamination ply; and a final barrier ply, an upper surface of the of the barrier ply defining the first surface of the first substrate.

44. The packaged good article of claim 43 wherein the plurality of perforations facilitate removal of only the internal storage region access portion of the seal membrane, and wherein upon removal of the access portion from a remaining portion of the seal membrane, the access portion separates from the remaining portion of the seal membrane at the plurality of perforations and the access portion separates from the inner surfaces of the panels at a junction of the delamination ply and the residual ply so as to leave the residual ply attached to the inner surfaces of the panels.

45. The packaged good article of claim 44 wherein the internal storage region access portion of the seal membrane includes indicia.

46. The packaged good article of claim 44 wherein the plurality of perforations are arranged in at least two continuous lines of perforations to ensure separation of the access portion from the remaining portion of the seal membrane.

47. The packaged good article of claim 46 wherein each line of perforations of the at least two lines of perforations is straight.

48. The packaged good article of claim 47 wherein the at least two lines of perforations are parallel.

49. The packaged good article of claim 48 wherein the at least two lines of perforations are closely spaced.

50. The packaged good article of claim 49 wherein the at least two lines of perforations extend substantially perpendicular to and between the opposing face panels.

51. The packaged good article of claim 31 wherein the particulate product is dry.

52. The packaged good article of claim 31 wherein the particulate product is a food product.

53. The packaged good article of claim 52 wherein the food product is a cereal.

54. The packaged good article of claim 52 wherein the food product is a ready-to-eat cereal.

55. The packaged good article of claim 31 wherein the bottom closure is a bottom panel connected to the opposing face panels and the opposing side panels, wherein the top closure is a top panel connected to the opposing face panels and the opposing side panels, and wherein the lid is positioned above the access portion of the seal membrane and configured to provide selective access to the internal storage region, and the particulate product disposed within, upon removal of the access portion of the seal membrane.

56. The packaged good article of claim 55 wherein the lid is movable from the closed position in which the lid is substantially contiguous with the body portion to prevent displacement of product from the internal storage region and the open position in which at least a portion of the lid is spaced from the body portion to allow passage of product from the internal storage region through a pour opening defined by a spacing of the lid from the body portion and absence of the access portion of the seal membrane.

57. The packaged good article of claim 31 wherein the internal storage region access portion of the seal membrane includes indicia.

* * * * *